US006094118A

United States Patent [19]

Bulgatz

[11] Patent Number: 6,094,118

[45] Date of Patent: Jul. 25, 2000

[54] ELECTROMAGNETIC ACTUATOR WITH STAMPED STEEL HOUSING

[75] Inventor: Dennis Bulgatz, Williamsburg, Va.

[73] Assignee: Siemens Automotive Corporation, Auburn Hills, Mich.

[21] Appl. No.: 09/203,124

[22] Filed: Dec. 1, 1998

Related U.S. Application Data

[60] Provisional application No. 60/069,144, Dec. 9, 1997.

[51] Int. Cl.[7] ..... H01F 7/00; H01F 5/00; H01F 7/08

[52] U.S. Cl. ..... 335/278

[58] Field of Search ..... 335/256, 266, 335/268, 278; 251/129.09, 129.1; 123/90.11

[56] References Cited

U.S. PATENT DOCUMENTS

| | | | |
|---|---|---|---|
| 3,838,371 | 9/1974 | Willette | 335/278 |
| 4,177,441 | 12/1979 | Lichtenberger | 335/270 |
| 4,386,684 | 6/1983 | Prokop | 188/138 |
| 4,749,167 | 6/1988 | Gottschall | 251/65 |
| 5,720,242 | 2/1998 | Izuo | 123/90.11 |
| 5,720,468 | 2/1998 | Morinigo | 251/129.1 |

*Primary Examiner*—Lincoln Donovan
*Assistant Examiner*—Raymond Barrera

[57] ABSTRACT

An electromagnetic actuator for an internal combustion engine includes upper and lower electromagnets each having first and second opposing sides. First and second spacers are provided. The first spacer is connected to the first sides of the electromagnets and the second spacer is connected to the second sides of the electromagnets such that the electromagnets are disposed between the spacers. The spacers are constructed and arranged with respect to the electromagnets to define a space between the electromagnets. An armature is mounted for movement in the space between the electromagnets. A stamped steel housing is connected to the first and second spacers. The housing is constructed and arranged to mount the actuator to a structure.

25 Claims, 2 Drawing Sheets

ELECTROMAGNETIC ACTUATOR WITH STAMPED STEEL HOUSING

This application claims the benefit of U.S. Provisional Application No. 60/069,144 filed Dec. 9, 1997, the contents of which is hereby incorporated by reference in its entirety herein.

FIELD OF THE INVENTION

This invention relates to an electromagnetic actuator for a vehicle engine and more particularly to an electromagnetic actuator having a stamped steel housing which contains the electromagnets.

BACKGROUND OF THE INVENTION

A conventional electromagnetic actuator for opening and closing a valve of an internal combustion engine generally includes "open" and "close" electromagnets which, when energized, produce an electromagnetic force on an armature. The armature is biased by a pair of identical springs arranged in parallel. The armature is coupled with a cylinder valve of the engine. The armature rests approximately half-way between the open and close electromagnets when the springs are in equilibrium. When the armature is held by a magnetic force in either the closed or opened position (at rest against the open or close electromagnet), potential energy is stored by the springs. If the magnetic force is shut off with the armature in the opened position, the spring's potential energy will be converted to kinetic energy of the moving mass and cause the armature to move towards the close electromagnet. If friction is sufficiently low, the armature can then be caught in the closed position by applying current to the close electromagnet.

The conventional electromagnetic actuator described above also includes a pair of housings, each housing containing an associated electromagnet. Typically, each housing is cast from aluminum which is of a material different from the lamination stack or core of the electromagnets. Actuators for use with an internal combustion engine have an ambient temperature operating range of −40 to 120 degrees Celsius, with peak operating temperatures estimated to reach 200 degrees Celsius. At these high temperatures, the aluminum housing will expand faster that the core, stressing the joints between the housing and the electromagnets as the actuator temperature rises.

There is a need to provide an electromagnetic actuator which is inexpensive to manufacture, has improved thermal expansion characteristics and which allows for more efficient actuator operation.

SUMMARY OF THE INVENTION

An object of the present invention is to fulfill the need referred to above. In accordance with the principles of the present invention, this objective is obtained by providing an electromagnetic actuator for an internal combustion engine. The actuator includes upper and lower electromagnets each having first and second opposing sides. First and second spacers are provided. The first spacer is connected to the first sides of the electromagnets and the second spacer is connected to the second sides of the electromagnets such that the electromagnets are disposed between the spacers. The spacers are constructed and arranged with respect to the electromagnets to define a space between the electromagnets. An armature is mounted for movement in the space between the electromagnets. A stamped steel housing is connected to the first and second spacers. The housing is constructed and arranged to mount the actuator to a structure.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
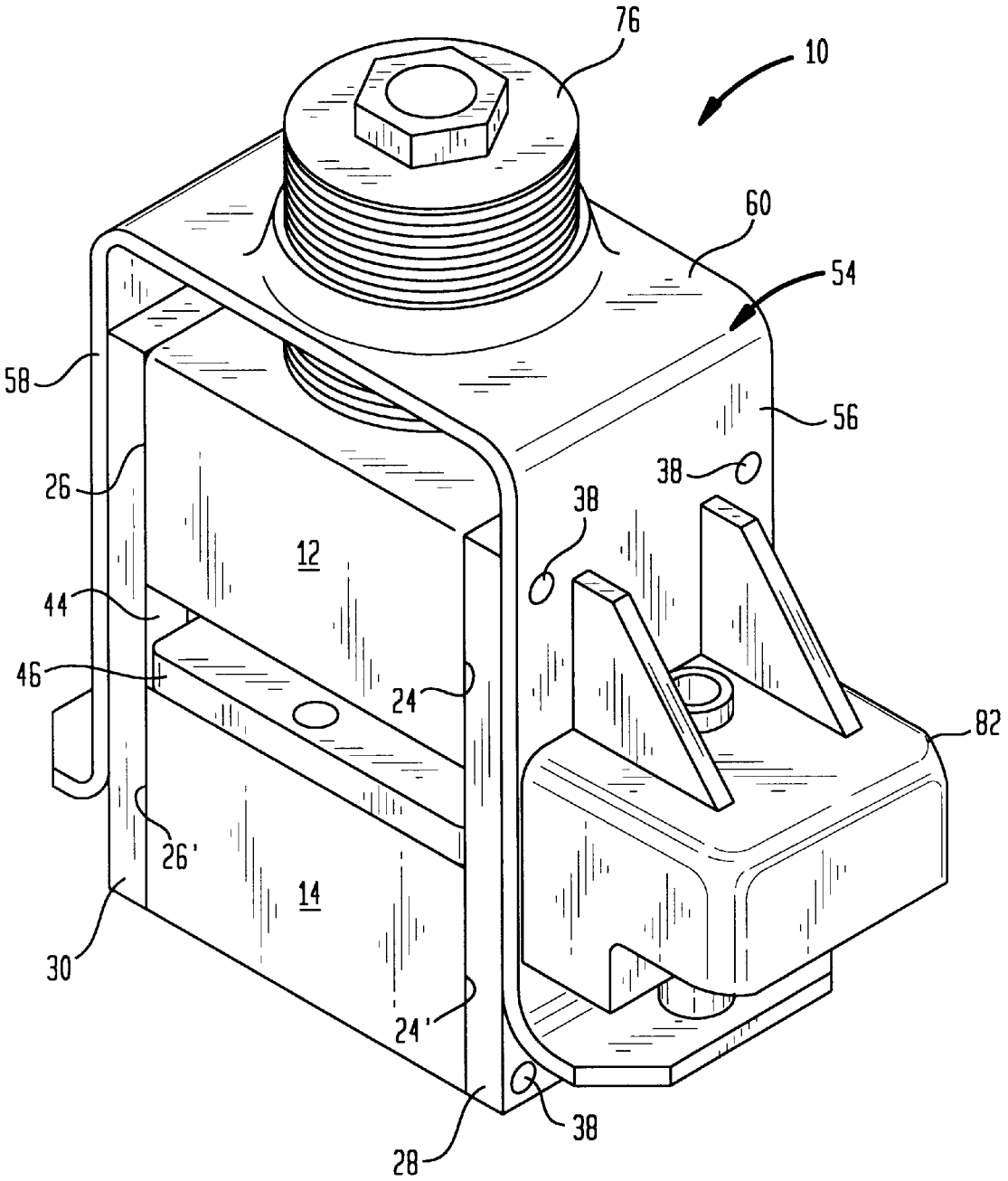
FIG. 1 is perspective view of an electromagnetic actuator provided in accordance with the principles of the present invention.
Figure 2:
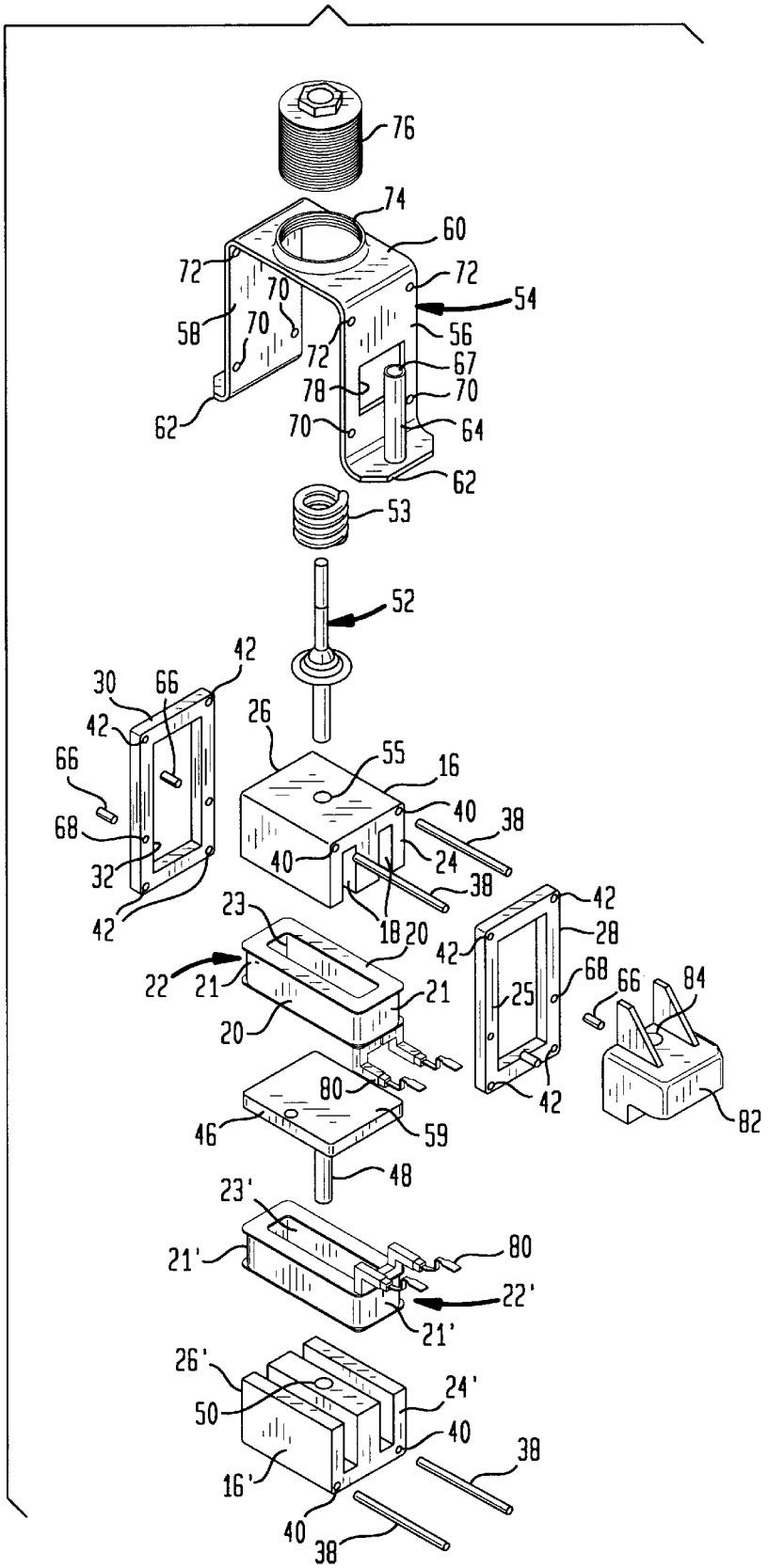
FIG. 2 is an exploded view of the electromagnetic actuator of FIG. 1.

Referring to FIG. 1, an electromagnetic actuator is shown, generally indicated 10, provided in accordance with the principles of the present invention for use in an internal combustion engine to control operation of a valve. The electromagnetic actuator 10 includes an upper electromagnet 12 and a lower electromagnet 14. With reference to FIG. 2, the electromagnets 12 and 14 are identically configured. In that regard, a detailed description of only the upper electromagnet 12 is provided. The upper electromagnet 12 includes a lamination stack 16 comprised of a plurality of individual laminations joined together to define the stack. The lamination stack 16 is generally E-shaped and includes a pair of channels 18 constructed and arranged to receive side walls 20 of an upper coil assembly, generally indicated at 22. The upper coil assembly 22 is of generally rectangular shape having side walls 20 and end walls 21 and a central opening 23 which is received by the lamination stack 16. The lamination stack 16 includes first and second generally planar opposing sides 24 and 26, respectively, the function of which will be explained below. Likewise, the lower electromagnet 14 includes a lamination stack 16' defining generally opposing sides 24' and 26', respectively. The lamination stack 16' is configured to receive the lower coil assembly, generally indicated at 22'.

With reference to FIG. 1, a first spacer 28 and a second spacer 30 join the upper and lower electromagnets together. Each of the spacers 28 and 30 are identically configured and are in the form of a generally rectangular plate having an opening 32 therethrough to receive ends 21 of the upper coil assembly 22 and the ends 21' of the lower coil assembly 22'. The thickness of each of the spacers 28 and 30 is such that the ends 21 and 21' of the upper and lower coil assemblies do not extend beyond an outer surface 25 of each of the spacers 28 and 30 (FIG. 2). The first spacer 28 is connected to the first side 24 of the upper electromagnet 12 and to the first side 24' of the lower electromagnet 14. In addition, the second spacer 30 is connected to the second side 26 of the upper electromagnet 12 and to the second side 26' of the lower electromagnet 14. In the illustrated embodiment, the spacers 28 and 30 are connected the electromagnets 12 and 14 via pins 38 which extend through openings 40 in the lamination stacks 16, 16' and are received in openings 42 in the spacers 28 and 30. It can be appreciated that other type of fasteners can be used instead of pins 38, such as bolts or rivets. The spacers 28 and 30 thus sandwich the electromagnets 12 and 14 and define a space 44 between the electromagnets 12 and 14.

An armature 46 is mounted for movement in the space 44 between the electromagnets 12 and 14. As shown in FIG. 2, a lower side of the armature includes a shaft 48 fixed thereto. The shaft 48 is received in a bore 50 which extends through the lamination stack 16'. The shaft 48 is associated with a spring and valve stem assembly (not shown) of a vehicle engine in the conventional manner. A shaft assembly, generally indicated at 52, and a spring 53 are associated with an upper side 54 of the armature 46. Thus, a portion of the shaft assembly 52 extends through a bore 55 in the lamination stack 16. The armature 46 is biased by the spring (not shown) of the spring and valve stem assembly and by spring 53. The armature 46 rests approximately half-way between the electromagnets 12 and 14 when the springs are in equilibrium. When the armature 46 is held by a magnetic force in either the closed or opened position (at rest against the upper or lower electromagnet), potential energy is stored by the springs. If the magnetic force is shut-off with the armature 46 at the upper (electromagnet 12, the potential energy of spring 53 will be converted to kinetic energy of the moving mass and cause the armature 46 to move towards the lower electromagnet 14. If friction is sufficiently low, the armature 46 can then be caught at the lower electromagnet 12 by applying current to the lower electromagnet.

In accordance with the invention and with reference to FIGS. 1 and 2, the electromagnetic actuator 10 includes a stamped, generally U-shaped housing, generally indicated 54. The housing 54 is stamped and bent sheet metal which can be either magnetic or non-magnetic steel. Low electrical conductivity of the steel is desired to reduce losses caused by eddy currents. The U-shaped housing 54 includes a pair of opposing legs 56 and 58 and a connection portion 60 connecting the legs 56 and 58. Leg 56 is coupled to spacer 28 while leg 58 is coupled to spacer 30. Thus, each leg 56 and 58 contacts an outer surface 25 of the associated spacer. In the illustrated embodiment, the legs 56 and 58 are coupled to the spacers 28 and 30 via pins 66 received in bores 68 defined in the spacers 28 and 30 and in bores 70 defined in the legs 56 and 58. It can be appreciated that instead of providing pins 66, bolts or rivets can be used to secure the housing 54 to the spacers 28 and 30. In addition, or in the alternative, the pins 38 may extend through bores 72 in the legs 56 and 58 to secure the electromagnets 12 and 14 and the spacers 28 and 30 to the housing 54.

Each of the legs 56 and 58 includes a mounting flange 62 constructed and arranged to receive a fastener for securing the actuator 10 to a structure. As shown FIG. 2, the housing 54 includes a fastener tube 64 connected to the flange 62. The fastener tube 64 has a bore 67 therethrough and a bore is provided in flange 62 to receive a bolt or screw for connecting the housing 54 to a structure. Flange 62 of leg 58 also includes a fastener tube (not shown). Instead of providing the fastener tubes 64, a bore can simply be provided in each of the mounting flanges 62 to receive a fastener.

The spacers 28 and 30 are constructed from stamped sheet metal, which can be either magnetic or non-magnetic. Is preferable to use magnetic materials for the housing 54 and for the spacers 28 and 30 so as to reduce the reluctance of the magnetic circuit when the armature 46 is more than approximately 0.5 mm from the upper or lower electromagnets, so as to increase the magnetic force.

As best shown in FIG. 2, the connection portion 60 of the housing 54 includes a threaded bore 74 therethrough constructed and arranged to receive a spring adjustment screw 76. The adjustment screw 76 permits adjustment of spring 53 of the actuator 10. In addition, the leg 56 of the housing 54 includes an opening 78 therethrough to receive the leads 80 of the upper coil 20 and of the lower coil 20'.

An over-molded plastic connector housing 82 is coupled to the housing 54 to cover the leads 80 of the coils. The connector housing 82 includes a bore 84 therethrough which mates with the bore 67 defined in the fastener tube 64 so that a mounting fastener can be passed through the connector housing 82 from above.

By using steel as the material for the housing 54 and spacers 28 and 30, which has nearly the same coefficient of thermal expansion as the lamination stacks, the housing 54, spacers and laminations stacks can expand approximately at the same rate. This minimizes stress on the joints between the housing 54 and the electromagnets 12 and 14 as the temperature of the actuator 10 increases.

A further benefit of the actuator 10 is that the magnetic housing 54 will act to shield the environment from electromagnetic waves by containing stray flux.

The stamped housing 54 and the spacers 28 and 30 allow very accurate location of the two lamination stacks 16, 16' to be maintained, since both electromagnets 12 and 14 are mounted to the same accurately stamped spacers 28 and 30. The lamination stacks can be compressed between the spacers 28 and 30 and housing 54 with pins or other fasteners, keeping both sides 24 and 26 of each lamination stack in good mechanical and thermal contact with the housing 54.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An electromagnetic actuator comprising:

upper and lower electromagnets each having first and second opposing sides, first and second spacers, said first spacer being connected directly to said first sides of said electromagnets and said second spacer being connected directly to said second sides of said electromagnets such that said electromagnets are disposed between said spacers, said spacers being constructed and arranged with respect to said electromagnets to define a space between said electromagnets, an armature mounted for movement in said space between said electromagnets, and a housing connected to said first and second spacers and being constructed and arranged to mount the actuator to a structure, said housing being generally U-shaped having opposing legs and a connection portion joining said opposing legs such that said legs are disposed generally transversely with respect to an extent of said connection portion, each of said legs being connected to an associated spacer so as to contact an outer surface thereof.

2. The actuator according to claim 1, wherein said housing is of stamped construction.

3. The actuator according to claim 1, wherein said connection portion includes a threaded bore therethrough.

4. The actuator according to claim 3, further comprising a shaft assembly operatively associated with said armature, a spring for biasing said shaft assembly and a spring adjustment screw received in said threaded bore for adjusting said spring.

5. The actuator according to claim 1, wherein said spacers are magnetic sheet steel.

6. The actuator according to claim 1 wherein said housing is magnetic sheet steel.

7. The actuator according to claim 1, wherein said housing includes at least one fastener receiving tube to receive a fastener for mounting the actuator to a structure.

8. The actuator according to claim 1, wherein said housing includes mounting flanges extending from said legs, each mounting flange being constructed and arranged to receive a fastener for mounting the actuator to a structure.

9. The actuator according to claim 1, wherein each of said electromagnets includes:

a lamination stack of generally E-shape defining a pair of channels therein, and a coil assembly having a pair of side walls and a pair of end walls, said side walls being received in said pair of channels.

10. The actuator according to claim 9, wherein each of said spacers has an opening therein to receive said end walls of said coil assemblies and each of said spacers has a thickness such that said end walls of said coil assemblies do not extend beyond an outer surface of said spacers.

11. The actuator according to claim 10, wherein said housing is generally u-shaped having opposing legs, and each of said legs contacts said outer surface of an associated spacer.

12. The actuator according to claim 1, further comprising a connector housing coupled to said housing so as to cover electrical leads of said electromagnets.

13. An electromagnetic actuator comprising:

upper and lower electromagnets each having first and second opposing sides, first and second steel spacers, said first spacer being connected directly to said first sides of said electromagnets and said second spacer being connected directly to said second sides of said electromagnets such that said electromagnets are disposed between said spacers, said spacers being constructed and arranged with respect to said electromagnets to define a space between said electromagnets, an armature mounted for movement in said space between said electromagnets, and a stamped, generally U-shaped housing having opposing legs and a connection portion joining the opposing legs such that said legs are disposed generally transversely with respect to an extent of said connection portion, each of said legs being coupled to an associated spacer so as to contact an outer surface thereof, at least one of said legs including a flange constructed ad arranged to mount the actuator to a structure.

14. The actuator according to claim 13, wherein said connection portion includes a threaded bore therethrough.

15. The actuator according to claim 14, further comprising a shaft assembly operatively associated with said armature, a spring for biasing said shaft assembly and a spring adjustment screw received in said threaded bore for adjusting said spring.

16. The actuator according to claim 13, wherein said spacers are stamped from magnetic sheet steel.

17. The actuator according to claim 13, wherein said steel of said housing is magnetic.

18. The actuator according to claim 13, wherein said housing includes at least one fastener receiving tube to receive a fastener for mounting the actuator to a structure.

19. The actuator according to claim 13, wherein each of said electromagnets includes:

a lamination stack of generally E-shape defining a pair of channels therein, and a coil assembly having a pair of side walls and a pair of end walls, said side walls being received in said pair of channels.

20. The actuator according to claim 19, wherein each of said spacers has an opening therein to receive said end walls of said coil assemblies and each of said spacers has a thickness such that said end walls of said coil assemblies do not extend beyond an outer surface of said spacers.

21. The actuator according to claim 20, wherein each of said legs contacts said outer surface of an associated spacer.

22. The actuator according to claim 13, further comprising a connector housing coupled to said stamped housing so as to cover electrical leads of said electromagnets.

23. The actuator according to claim 13, wherein each of said legs includes a flange.

24. An electromagnetic actuator comprising:

upper and lower electromagnets each having first and second opposing sides, first and second spacers, said first spacer being connected to said first sides of said electromagnets and said second spacer being connected to said second sides of said electromagnets such that said electromagnets are disposed between said spacers, said spacers being constructed and arranged with respect to said electromagnets to define a space between said electromagnets, an armature mounted for movement in said space between said electromagnets, and a housing connected to said first and second spacers and being constructed and arranged to mount the actuator to a structure, wherein each of said electromagnets includes:

a lamination stack of generally E-shape defining a pair of channels therein, and a coil assembly having a pair of side walls and a pair of end walls, said side walls being received in said pair of channels.

25. An electromagnetic actuator comprising:

upper and louver electromagnets each having first and second opposing sides, first and second steel spacers, said first spacer being connected to said first sides of said electromagnets and said second spacer being connected to said second sides of said electromagnets such that said electromagnets are disposed between said spacers, said spacers being constructed and arranged with respect to said electromagnets to define a space between said electromagnets, an armature mounted for movement in said space between said electromagnets, and a stamped, generally U-shaped housing having opposing legs and a connection portion joining the opposing legs, each of said legs being coupled to an associated spacer, at least one of said legs including a flange constructed and arranged to mount the actuator to a structure, wherein each of said electromagnets includes:

a lamination stack of generally E-shape defining a pair of channels therein, and a coil assembly having a pair of side walls and a pair of end walls, said side walls being received in said pair of channels.

* * * * *